US006588500B2

(12) United States Patent
Lewis

(10) Patent No.: US 6,588,500 B2
(45) Date of Patent: Jul. 8, 2003

(54) ENHANCED OIL WELL PRODUCTION SYSTEM

(76) Inventor: Ken Lewis, 14006 Blazey Dr., Houston, TX (US) 77095

( * ) Notice: Subject to any disclaimer, the term of this patent is extended or adjusted under 35 U.S.C. 154(b) by 0 days.

(21) Appl. No.: 09/770,824

(22) Filed: Jan. 26, 2001

(65) Prior Publication Data

US 2002/0100587 A1 Aug. 1, 2002

(51) Int. Cl.[7] ..... E21B 29/12; E21B 36/00; E21B 43/24

(52) U.S. Cl. ..... 166/61; 166/57; 166/248; 166/368; 166/272.1

(58) Field of Search ..... 166/60, 61, 57, 166/58, 901, 248, 368, 272.1, 272.6

(56) References Cited

U.S. PATENT DOCUMENTS

| | | | | | |
|---|---|---|---|---|---|
| 2,911,047 | A | * | 11/1959 | Henderson | 166/302 |
| 2,914,124 | A | * | 11/1959 | Ripley, Jr. | 165/45 |
| 3,062,289 | A | * | 11/1962 | Eades | 165/45 |
| 3,420,302 | A | * | 1/1969 | Edwards | 166/303 |
| 3,578,077 | A | * | 5/1971 | Glenn et al. | 137/115.02 |
| 3,749,163 | A | * | 7/1973 | Waters | 165/104.26 |
| 3,908,763 | A | * | 9/1975 | Chapman | 166/302 |
| 4,120,357 | A | * | 10/1978 | Anderson | 166/245 |
| 4,154,297 | A | * | 5/1979 | Austin | 165/163 |
| 4,248,298 | A | * | 2/1981 | Lamers et al. | 138/111 |
| 4,396,063 | A | * | 8/1983 | Godbey | 166/250.06 |
| 4,583,589 | A | * | 4/1986 | Kasevich | 166/248 |
| 4,641,710 | A | * | 2/1987 | Klinger | 166/266 |
| 4,989,671 | A | * | 2/1991 | Lamp | 137/624.2 |
| 6,009,940 | A | | 1/2000 | Eck et al. | |
| 6,102,122 | A | * | 8/2000 | de Rouffignac | 166/250.01 |
| 6,112,808 | A | | 9/2000 | Isted | |

* cited by examiner

*Primary Examiner*—Thomas B. Will
*Assistant Examiner*—Thomas A. Beach
(74) *Attorney, Agent, or Firm*—Streets & Steele; Jeffrey L. Streets

(57) ABSTRACT

A closed loop heat transfer system located on the surface near the wellhead for transporting hot fluid through a tubing located in the annulus between the well casing and the outer surface of the production string. The tubing extends down along the production string to a coil submerged in the oil reservoir in the vicinity of the production pump and back to the surface for reheating and recirculation. The tubing provides heat transfer from the hot fluid to the production fluid, as well as the downhole pump and the region of the oil reservoir surrounding the pump. The system is preferably operated to transfer enough heat to the oil to prevent paraffins from coagulating and forming deposits on the production string or sucker rods, if used. The higher temperature lowers the viscosity of the oil and increases oil production.

16 Claims, 2 Drawing Sheets

ENHANCED OIL WELL PRODUCTION SYSTEM

BACKGROUND OF THE INVENTION

1. Field of the Invention

The present invention relates to an apparatus and method for the enhanced removal of high viscosity crude oil from downhole formations.

2. Background of the Related Art

The quick and efficient movement of oil from its natural reservoir or formation, typically located thousands of feet below the earth's surface, to the surface is important to the economically feasibility of producing from a given well. Increasing the temperature of oil that has a high viscosity will make the oil flow more efficiently and thereby possibly increase the amount of oil to be pumped while decreasing the operational expense of removing the oil.

The raising of the temperature of the oil located in the reservoir adjacent to the pump intake will increase the pump's ability to quickly and more effectively move the oil from the reservoir to the production string. This will also increase the oil production rate for the well.

Another problem arises when oils contain a high percentage of paraffins. Paraffins will solidify as the temperature of the oil decreases. These paraffin deposits will form deposits, or a general coating, on the inside diameter of the tubular sections that are used to move the oil from the reservoir to the surface. It will also form deposits or a coating on the sucker rods that are used to pump the oil, if the well in question, uses this type of oil removal pumping devise. These deposits of paraffin restrict the flow of oil and will eventually choke off the flow of material to the surface. The resulting restricted flow not only reduces production rates but causes premature failure of the pump located in the oil reservoir and premature failure of the sucker rods in walking beam pumps and other type of pumps that are located whole in the reservoir area, an example of which would be a submersible pump. The result of this buildup causes a periodic shutdown of the well for various types of cleaning. Keeping these paraffins above the temperature where they solidify would prevent these deposits from occurring and thereby allow for longer production schedules.

Therefore, there is a need to raise the temperature of the oil while it is being transported from the reservoir to the surface. Since oil is made up hydrocarbons and is therefore combustible, it is desirable that a method be devised to raise the temperature without the use of heating devises that are placed down hole where exposure to these high temperature devises may cause ignition of these hydrocarbons. Additionally, the use of other methods of warming the oil, such as using other precious resources like water, are considered to be inappropriate since there is a danger that the water would become contaminated by oil, or other chemical components located below the earth's surface. It is also important that a method be provided that supplies a consistent source of warmth to provide consistent production without interruptions.

SUMMARY OF THE INVENTION

The present invention provides a method of increasing oil production from a downhole formation through a production tubing to a wellhead. One embodiment of the method comprises heating a working fluid at the wellhead and circulating the heated working fluid through a conduit that is secured in thermal communication with the production tubing. The conduit extends from a heating system adjacent the wellhead to a downhole pump at a distal end of the production tubing and back to the heating system. Preferably, the rate of heat transfer from the working fluid to the oil in the production tubing is controlled to increase the rate of oil production. The step of controlling the rate of heat transfer may include a step selected from controlling the temperature of the working fluid exiting the heating system, controlling the rate of circulating the working fluid, or a combination thereof. It is preferred that the conduit allow for the expansion of the working fluid. It is also preferred to monitor the temperature of the oil produced from the production tubing at the wellhead and monitor the flow rate of the oil produced from the production tubing at the wellhead. The method provides the ability to control the working fluid temperature exiting the heating system to produce a desired flow rate of the oil.

The invention also provides a system or apparatus for increasing oil production from a downhole formation through a production tubing to a wellhead. The system comprises a heater adjacent the wellhead for heating a working fluid, a pump adjacent the wellhead for circulating the working fluid, and a closed loop of tubing filled with the working fluid. The closed loop of tubing includes the heater and the pump, and the closed loop of tubing is secured in thermal communication with the production tubing. A plurality of clamps are used to secure the closed loop of tubing in thermal communication with the production tubing, wherein the clamps are spaced apart along the production tubing down to the distal end of the production tubing. The preferred embodiment further comprises an accumulator in fluid communication with the close loop to allow expansion of the working fluid. The system is preferably controlled by a programmable controller in electronic communication with a flow meter for measuring the rate of oil production through the production tubing, a temperature probe for measuring the temperature of the oil, and/or a temperature probe for measuring the temperature of the working fluid. Optionally, the controller may be programmed to increase the temperature of the working fluid exiting the heater in order to provide an increase in the rate of oil production. It is also optional for the pump to include a variable speed motor allowing for changes in the circulation rate of the working fluid. Finally, the closed loop may also include one or more devices selected from an air purge line, a pressure sensor, or combinations thereof.

BRIEF DESCRIPTION OF THE DRAWINGS

So that the manner in which the above recited features and advantages of the present invention are attained can be understood in detail, a more particular description of the invention, briefly summarized above, may be obtained by reference to the embodiments thereof that are illustrated in the appended drawings. It is to be noted, however, that the appended drawings illustrate only typical embodiments of this invention and are therefore not to be considered limited of its scope, because the invention may admit to other equally effective embodiments.

DETAILED DESCRIPTION OF THE PREFERRED EMBODIMENT

Figure 1:
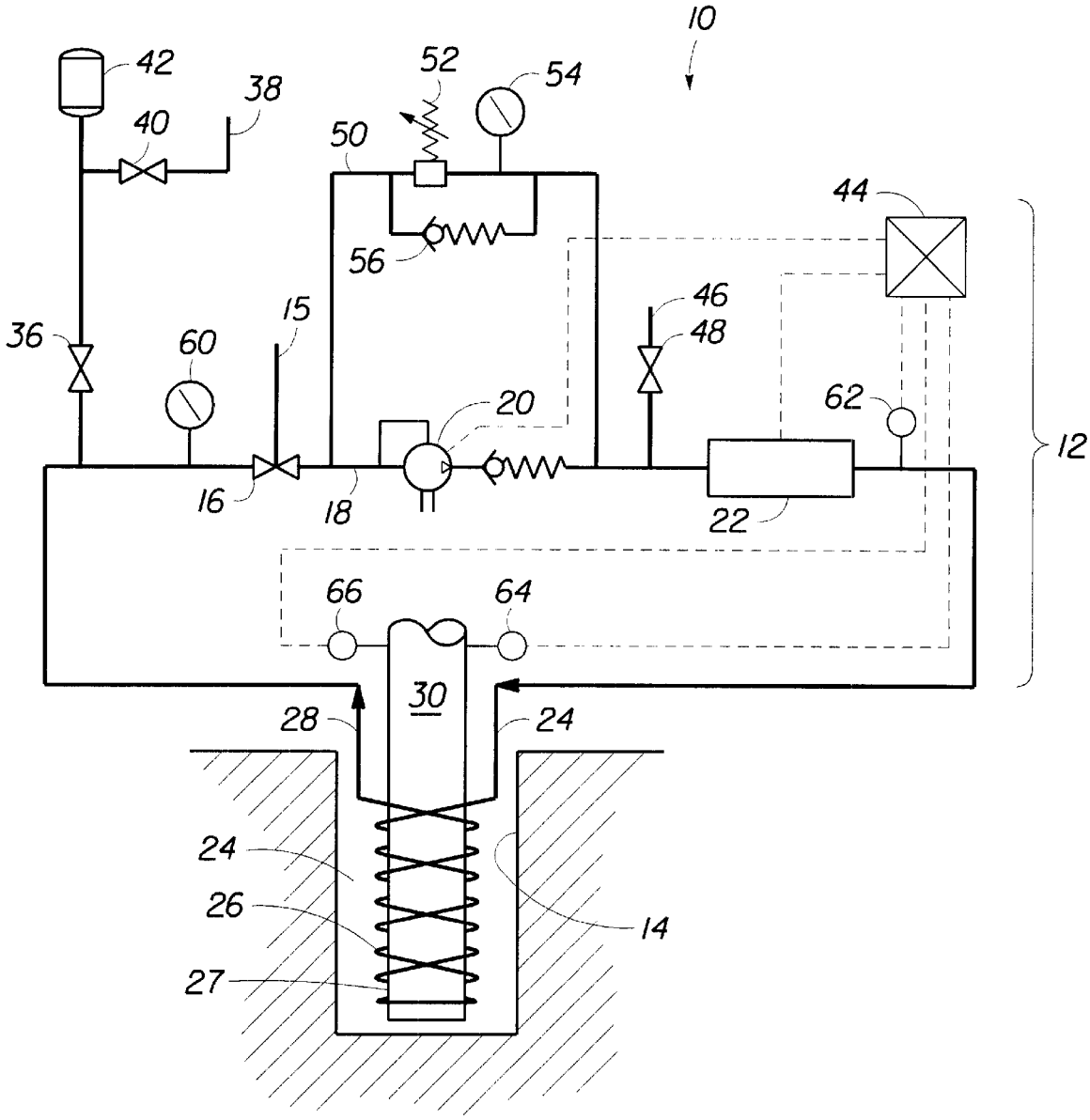
FIG. 1 is a schematic view of one embodiment of a closed loop heating system that circulates a dedicated heat transfer fluid or oil between a heater subsystem and the production well.

The present invention provides a system where a fluid specifically designed to be heated to a very high temperature, commonly known as "heat transfer fluid", is placed in a closed loop system that has a heating system located on the surface near the well. The heat transfer fluid is transported from the heating system through supply tubing located in the annulus between the well casing and the outer surface of the production string. The fluid travels through the supply tubing down the length of the production string to a coil submerged in the oil reservoir in the vicinity of the inlet to a production pump. After passing around the pump, the fluid is transported uphole to the wellhead through return tubing located adjacent to the supply tubing. The supply and return tubing are clamped or otherwise secured to the production string so that heat is transferred from the heat transfer fluid to the fluid being produced upward through the production string, as well as the pump and region of the oil reservoir surrounding the pump. The heat transfer fluid in the return tubing is transported back to the heating system. Following the reheating of the heat transfer fluid, the fluid is recirculated through the closed loop system, preferably continuously. The aforementioned heating system with supply and return tubing is preferably operated to transfer enough heat to the oil to increase and maintain the oil at a temperature that keeps paraffins from coagulating and forming deposits on either the inner surface of the production string or sucker rods, if used. The higher temperature lowers the viscosity of the oil and increases oil production.

A preferred embodiment of the heating system provides an independent heating system that operates in conjunction with, but not as apart of, the well's production fluid collection system. This heating system is preferably placed as closely as possible to the downhole pump to minimize the amount of heat that is lost from the system, but is not necessary for the heating system to be operational to continue pumping oil. The heating system can be shut down for periodic maintenance, or for emergency maintenance without immediately effecting oil well operations.

It is preferred to insulate as much of the tubing filled with heat transfer fluid as possible in order to minimize loss of heat from the fluid to the surrounding environment. Most preferably, insulation is applied to the tubing downhole in the well, as well as the tubing at the surface outside the wellhead. Furthermore, running the supply tubing and the return tubing side-by-side along the length of the production string will further reduce heat loss since the temperature of the return tubing will presumably be greater than the temperature of the surrounding environment. Regardless, it may still be desirable to provide a layer of insulation between the supply tubing and return tubing in order to deliver heat transfer fluid to the coil around the pump at the highest temperature possible.

The heating unit or system comprises an inlet tube that attaches to the return tubing extending from the wellhead and an outlet tube that attaches to the supply tubing extending into the annulus of the well. Between the inlet and outlet tubes, the heating unit provides communication of the heat transfer fluid to a fluid expansion chamber, a circulation pump, and the heater itself. The chamber, such as an accumulator, is designed to accommodate the thermal expansion inherent with the heat transfer fluid when it is heated beyond ambient temperature. The circulation pump then pressurizes the heat transfer fluid into a heater chamber that preferably raises the temperature of the fluid to a desired set point temperature. The hot fluid then exits the heating unit and flows through connecting tubing to the downward directed supply tubing. The heat transfer fluid completes a cycle through the system by passing through the coil around the pump and up the return tubing to the heating system. This closed loop design provides for recirculation of heat transfer fluid and the supply of heated fluid to raise or maintain the temperature of the oil in the production string.

The heat transfer fluid must be capable of being heated to temperatures greater than 500° F. A suitable heat transfer fluid includes THERMINOL (available from Solutia, Inc. of St. Louis, Mo.), MARLOTHERM (available from Condea Vista of Houston, Tex.), and DOWTHERM (available from The Dow Chemical Company of Midland, Mich.). The heating unit should be capable of heating the fluid to these temperatures on a continuous basis as the fluid completes its cycle through the system.

The tubing should be made of a material capable of handling the extreme temperatures of the heat transfer fluid, as well as the being resistant to attack by the heat transfer fluid or the downhole environment, for an undeterminable amount of time. Preferably the tubing material is stainless steel. The tubing shall be of a size that will allow insertion and clamping of the two tubes side by side within the annulus between the casing and the outer surface of the production tubing.

The pump and expansion vessel should be capable of continuous service at the elevated temperature of the heat transfer fluid and capable of moving the fluid at a sufficient rate as to properly exchange the heat in the fluid to the fluid in the production string and oil reservoir.

It is preferable to use a thin blanket of insulation to encapsulate the three conduits that extend from the well head located at the earth's surface to the pump at the bottom of the well, namely the three conduits being the production string, the supply tubing, and the return tubing. The insulation blanket should be wrapped around the three tubes before or during the process of inserting the conduits into the well. The insulation blanket should be wrapped in a manner that will minimize the loss of heat from the heat transfer fluid into the annulus, downhole casing, and the surrounding sub terrain. It is important to exchange as much heat as is available from the heat transfer fluid into the production string and oil reservoir. If used, the insulation blanket should be secured to one or more of the conduits, preferably by using the same clamps used to secure and stabilize the supply and return tubes to the production tubing.

The production string must be pulled out of the well for installation of the supply tubing, coil, return tubing, insulation and clamps. The production string is then returned to the well and the supply tubing and return tubing are coupled to the rest of the system at the surface. The system of the present invention can be used on both new and existing oil wells, using either new or existing production string or pipe.

FIG. 1 is a schematic view of one embodiment of a closed loop heating system 10 that circulates a dedicated heat transfer fluid or oil between a heater subsystem 12 and tubing in the production well 14. Heat transfer fluid is injected into the heating system 12 via the system fill line 14 and then through a three-way valve 16. The three-way valve 16 is placed in the position that allows fluid to flow from the system fill line into the stainless steel tubing 18 in a direction that will cause the fluid to flow to the displacement pump 20. When fluid has reached the pump, the pump 20 is turned on to force the fluid from the pump 20 into the heater 22 then throughout the remainder of the system 10. The remainder of the tubing shall include tubing that shall be installed from the wellhead (not shown) downward in the annular space between the well casing and the outer surface of the production string 30. The downhole tubing of the system 10, including supply tubing 24, coil 26 and return tubing 28, shall be attached to the production tubing at spaced intervals by means of clamps. Once the tubing has reached the downhole pump area, a coiled section 26 is formed around the downhole pump 27.

In an alternative method of filling the system with heat transfer fluid, the downhole tubing is filled with the fluid offsite and used in a hydrotest procedure that checks the integrity of the tubing before taking the tubing to the field for installation. Following the hydrotest, it may be desirable to cap off the ends of the tubing and transport the entire spool of tubing to the field with the fluid still inside. Similarly, the heater and related fittings may be filled and tested offsite and sent to the field with fluid still inside. In the field, the tubing and the heater are connected so that the system is full or substantially full of fluid without having to handle the fluid in the field.

Figure 2:
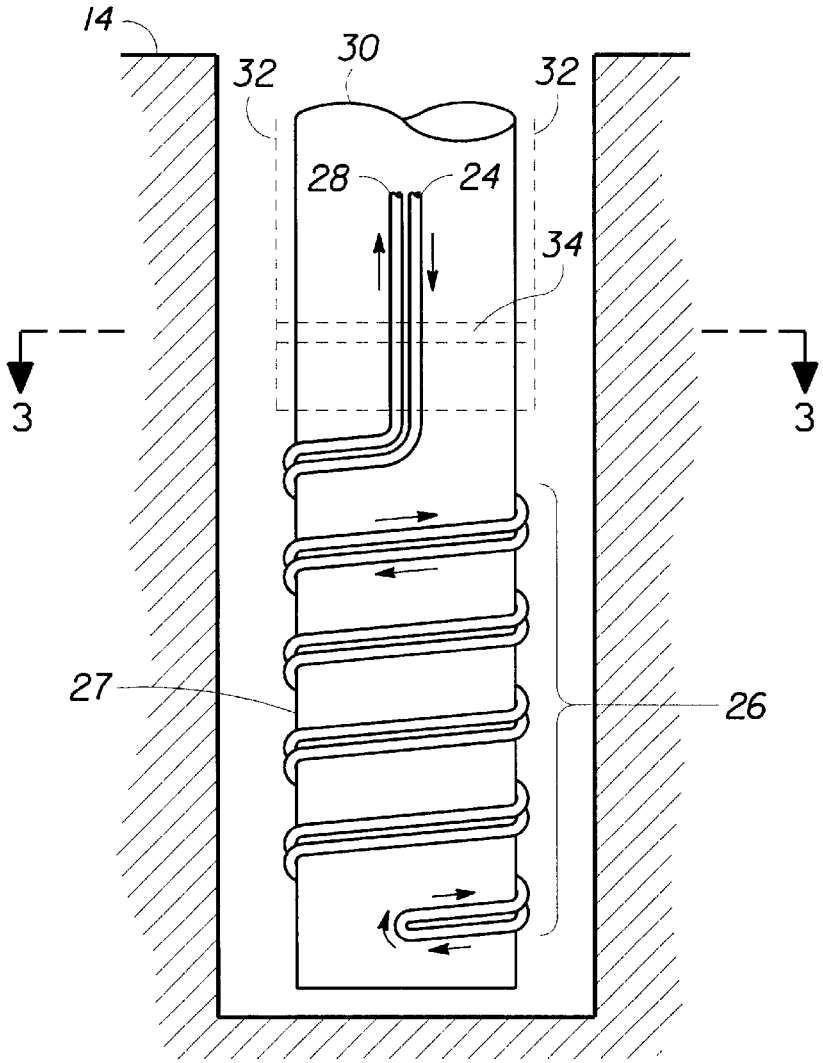
FIG. 2 is a side view of a supply tubing, coil and return tubing for circulating the hot working fluid in thermal communication with the production tubing or string.
Figure 3:
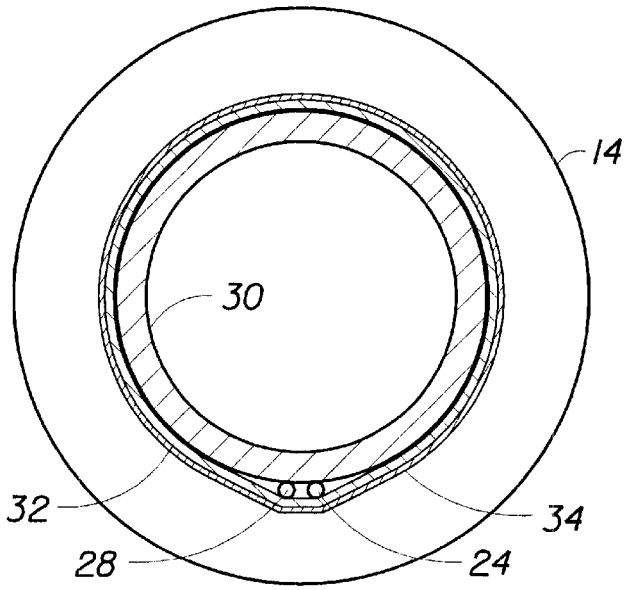
FIG. 3 is a cross-sectional view of the apparatus of FIG. 2 showing the supply tubing and return tubing secured to the production string.

Referring briefly to FIG. 2, it is shown that the coiled section 26 is coiled in a downward configuration around the downhole pump 27 from supply tubing 24, then the coil turns upward adjacent the downward spiral to the return tubing 28. The supply tubing 24 is shown running adjacent and generally parallel to the return tubing 28 along the length of the production string 30. The tubing 24, 28 is surrounded by the insulating blanket 32 and attached to production string 30 by a clamp 34. The arrangement of these components is further illustrated by a cross-sectional view in FIG. 3.

Referring back to FIG. 1, the return tubing 28 exits the wellhead then re-enter the heater system 12 for re-heating of the fluid. As the heat transfer fluid enters the heating system 12 it passes along through the tubing 18 and into communication a two-way valve 36 that leads to an air purge line 38 with a two-way valve 40 and to an accumulator 42. The accumulator 42 is charged to a low pressure with an inert gas, such as nitrogen, and serves as an expansion containment vessel for the volume of heat transfer fluid that increases as the temperature of the heat transfer fluid rises. As the heat transfer fluid enters the tubing 18 from the return tubing 28, the two-way valves 36, 40 should remain open. Once the heat transfer fluid fills the tubing 18 to the limit of the air purge line 38, then the two-way valve 40 is closed. The three-way valve 16 is then also moved into position to close the fill line 14 and allow flow throughout the tubing 18. The two-way valve 36 should remain open during normal operation, but the valve can be shut off to deny access of fluid to the accumulator should replacement or repair of the accumulator be necessary.

The heater unit 22 is not turned on until the system 10 is fully charged with the heat transfer fluid. Once the fluid fills the entire system, the heater 22 is turned on, preferably by use of the control panel 44. The control panel 44 is preferably programmable to operate the heater 22 in a manner that provides a progressive increase in the temperatures within the system 10 by periodically increasing the rate of heating until the heat transfer fluid exiting the heater 22 reaches a desired temperature. Since the heat transfer fluid is subject to deterioration from prolonged use or excessive temperatures, it is recommended that a sample of the heat transfer fluid be extracted from the system from time to time for analysis. A sample port 46 is included in the system whereby fluid shall be gathered by opening a two-way valve 48.

To prevent damage to the pumping system from potential blockages of the tubing and fluid surges against the inlet of the pump 20 caused by a sudden loss of pumping due to anomalies such as power failures, a bypass 50 is provided from the inlet side of the pump 20 to the discharge side of the pump 20. This bypass 50 shall have a pressure relief valve 52 that shall activate should a predetermined pressure be obtained on the discharge side of the pump 20. If the relief valve 52 opens, it will release heat transfer fluid from the discharge side of the pump 20 to the inlet side of the pump 20, thereby relieving the pressure on the pump before damage to the pump can occur. A pressure gauge 54 shall be incorporated into the bypass system 50 to monitor the pressure. A back flow prevention valve 56 may be installed to ensure that the flow is forced forward. An additional back flow prevention valve 58 may be installed adjacent to the discharge side of the pump 20 to further ensure that the flow does not enter the pump and is forced forward. A pressure gauge 60 is installed prior to the charge side of the pump to measure line pressure of the system as the heat transfer fluid is returned for re-heating.

Once the proper outlet temperature of the heat transfer fluid is obtained, the system is preferably placed in continuous operation with shut down occurring only on an emergency or maintenance basis. The temperature of the heat transfer fluid will be adjusted by the controller through input to the heater, preferably to maintain the heat transfer fluid exiting the heater at a constant temperature as measured by temperature monitor 62 and to prevent the system 10 from overheating as the heating requirement of the production string 30 stabilizes.

The controller may operate the heater to provide a constant or varying exit temperature from the heater and could optionally also control the pump speed to provide a desired heat transfer to the production string. In one preferred method, the heat transfer fluid is brought up to a set point temperature, then, as the temperature of the oil exiting the production string increases to the point where the oil production rate is maximized, the controller starts reducing the heat to maximize the efficiency of the utility usage, i.e., the lowest kilowatts per unit of oil produced. Consequently, a temperature probe 64, such as an ultrasonic monitor, is provided to monitor the temperature of the oil in the production string as it is produced and a flow rate sensor 66 is provided to monitor the flow rate of oil being produced. It should be recognized that the temperature of the oil being produced should be kept below the boiling point of water, since water may be present in the oil.

While the foregoing is directed to the preferred embodiment of the present invention, other and further embodiments of the invention may be devised without departing from the basic scope thereof, and the scope thereof is determined by the claims that follow.

I claim:

1. A method of increasing oil production from a downhole formation through a production tubing to a wellhead, comprising:

(a) heating a working fluid at the wellhead;

(b) circulating the heated working fluid through a conduit that is secured in thermal communication with the production tubing, wherein the conduit extends from a heating system adjacent the wellhead to a downhole pump at a distal end of the production tubing and back to the heating system;

(c) controlling the rate of heat transfer from the working fluid to the oil in the production tubing to increase the rate of oil production by decreasing the viscosity of the oil by increasing the temperature of the oil to be above the melting point of paraffin.

2. The method of claim 1, wherein the step of controlling the rate of heat transfer includes controlling the temperature of the working fluid exiting the heating system.

3. The method of claim 1, wherein the step of controlling the rate of heat transfer includes controlling the rate of circulating the working fluid.

4. The method of claim 1, further comprising allowing for the expansion of the working fluid.

5. The method of claim 1, further comprising monitoring the temperature of the oil produced from the production tubing at the wellhead.

6. The method of claim 1, further comprising monitoring the flow rate of the oil produced from the production tubing at the wellhead.

7. The method of claim 6, wherein the step of controlling the rate of heat transfer includes controlling the temperature of the working fluid exiting the heating system.

8. The method of claim 7, further comprising controlling the working fluid temperature exiting the heating system to produce a desired flow rate of the oil.

9. The method of claim 6, further comprising controlling the flow rate of the oil produced by changing the rate of heat transfer from the working fluid to the oil, wherein the rate of heat transfer is changed by controlling the temperature of the working fluid exiting the heating system and then, if necessary, controlling the rate of circulating the working fluid.

10. A system for increasing oil production from a downhole formation through a production tubing to a wellhead, comprising:

(a) a heater adjacent the wellhead for heating a working fluid;

(b) a pump adjacent the wellhead for circulating the working fluid;

(c) a closed loop of tubing filled with the working fluid and extending to a downhole pump at a distal end of the production tubing, wherein the closed loop of tubing includes the heater and the adjacent pump, and wherein the closed loop of tubing is secured against and in thermal communication with the production tubing; and (d) a plurality of clamps securing the closed loop of tubing against and in thermal communication with the production tubing, wherein the clamps are spaced apart along the production tubing down to the distal end of the production tubing, and wherein the thermal communication decreases the viscosity of the oil by increasing the temperature of the oil to be above the melting point of paraffin.

11. The system of claim 10, further comprising an accumulator in fluid communication with the close loop to allow expansion of the working fluid.

12. The system of claim 10, further comprising a flow meter for measuring the rate of oil production through the production tubing.

13. The system of claim 12, further comprising a temperature probe for measuring the temperature of the working fluid.

14. The system of claim 13, further comprising a controller for increasing the temperature of the working fluid exiting the heater to provide an increase in the rate of oil production.

15. The system of claim 10, wherein the pump comprises a variable speed motor.

16. The system of claim 10, wherein the closed loop includes one or more devices selected from an air purge line, an accumulator, a pressure sensor, or combinations thereof.

* * * * *